United States Patent [19]

Eriksson et al.

[11] Patent Number: 4,512,125

[45] Date of Patent: Apr. 23, 1985

[54] ELEMENTS FOR SUPPORTING AND BRACING SEALED-GLAZING UNITS

[75] Inventors: Lars E. Eriksson, Storgatan 40, S-361 00 Emmaboda, Sweden; Göte Rickardsson, Gislaved, Sweden

[73] Assignee: Lars Erik Eriksson, Sweden

[21] Appl. No.: 598,317

[22] PCT Filed: Jul. 30, 1982

[86] PCT No.: PCT/SE82/00253

§ 371 Date: Mar. 28, 1984

§ 102(e) Date: Mar. 28, 1984

[87] PCT Pub. No.: WO84/00574

PCT Pub. Date: Feb. 16, 1984

[51] Int. Cl.[3] ..... E06B 7/14

[52] U.S. Cl. ..... 52/209; 52/397; 52/730; 52/777

[58] Field of Search ..... 52/397, 398, 403, 209, 52/402, 730, 490, 776, 777, 780

[56] References Cited

U.S. PATENT DOCUMENTS 4,458,464 7/1984 Borghetto ..... 52/477

*Primary Examiner*—Carl D. Friedman

*Assistant Examiner*—Creighton Smith

*Attorney, Agent, or Firm*—Ostrolenk, Faber, Gerb & Soffen

[57] ABSTRACT

A supporting and bracing element is disclosed for engaging an edge of a plate-like unit such as a sealed glazing unit, received by a frame. The supporting and bracing element comprises an elongated disc-shaped body having at least two longitudinally extending edge ribs. At least one loop formation extends between the edge ribs at one of their short sides and also extends perpendicular to the upper- or underside of the edge ribs beyond the thickness of the edge ribs. The loop formation is movable for being jammed between the edge portion of the sealed glazing unit and the surrounding frame bar during the mounting of the sealed glazing unit.

15 Claims, 3 Drawing Figures

ELEMENTS FOR SUPPORTING AND BRACING SEALED-GLAZING UNITS

BACKGROUND OF THE INVENTION

I. Field of the Invention

The present invention relates to elements for supporting and bracing sealed-glazing units or similar plate-like bodies intended to be placed between the edge portion of a sealed glazing unit and the surrounding frame bar in order to support or brace the sealed glazing unit at a predetermined distance from the frame bar.

II. Description of the Prior Art

Supporting and bracing elements are used when mounting sealed-glazing units between the edge portion of the sealed-glazing unit and the frame bar in order to support the sealed-glazing unit and when casement windows are used also to brace said unit laterally. The purpose of the elements is to distribute the pressure forces acting between the unit and the casement or frame in a manner so controlled that the panes of glass in the unit take up substantially equal pressure forces. The elements used up to now usually consist of an elongated, disc-shaped body, the width of which exceeds by a short distance the width of said unit. A large problem in using the known elements occurs especially when bracing said units laterally. In these cases jamming forces between the unit and the surrounding frame bar often cannot keep the elements in their positions so that the elements therefore slide down along the flange of the frame bar and are gathered in the lowermost corner of the sealed glazing unit.

SUMMARY OF THE INVENTION

An object of the present invention is to provide a supporting and bracing element of the type described in the introduction, in which the drawbacks to be found with the known elements mentioned above are entirely eliminated without using adhesive or other mounts which are expensive and difficult to handle. This is obtained with an element of the kind in question which, in accordance with the invention, comprises at least two parallel, longitudinally extending edge ribs connected to each other by a central part having a thickness less than the thickness of the parallelly extending edge ribs. Said ribs are provided with at least one loop formation located between the two edge ribs in a transverse direction preferably at one of their short sides. Said loop formation extends perpendicular to the upper-or underside of the edge ribs a distance exceeding the thickness of the edge ribs and said loop formation being provided to be jammed between the edge portion of the sealed glazing unit and the surrounding frame bar before or when mounting the sealed glazing unit.

By virtue of the invention there is now obtained a supporting and bracing element which admirably fulfils its objects, but which is simultaneously simple and cheap to manufacture. By means of the loop formation of the supporting and bracing element, it is prevented from sliding downwards before or when mounting the glazing bar. The parallel elongated edge ribs, owing to their elongated grooving, can be combined or coupled together with corresponding grooving on the edge ribs of other supporting and bracing elements without sliding laterally in relation to each other. By the special configuration of the centrally located part a drainage is obtained permitting condensation or moisture to get out from the frame bar by way of drainage openings provided in said frame bar. The locking pins extending from one side of the edge ribs in a direction opposite to the loop formation are provided to fix the supporting and bracing element in its placed position after mounting of the glazing bar.

BRIEF DESCRIPTION OF THE DRAWINGS

So that the invention will be more readily understood and further features thereby made apparent, an exemplary embodiment of the invention will now be described with reference to the accompanying schematic drawings, in which.

DETAILED DESCRIPTION OF THE PREFERRED EMBODIMENTS

Figure 1:
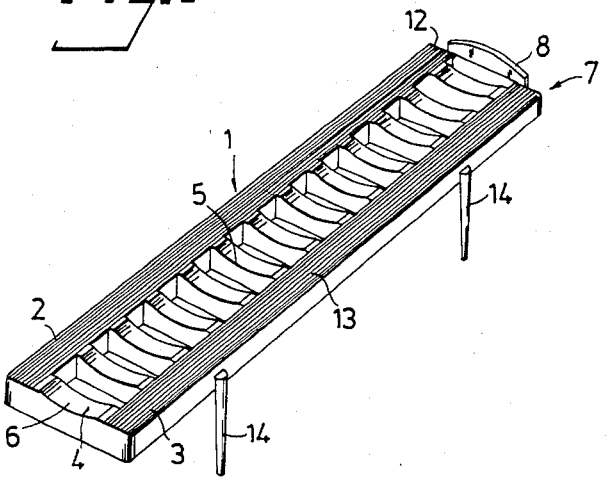
FIG. 1 is a perspective view of a supporting and bracing element according to the present invention.
Figure 2:
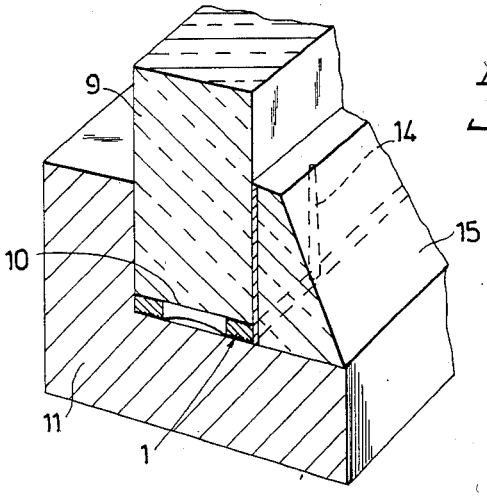
FIG. 2 illustrates an element according to the invention mounted in a glazed frame bar.
Figure 3:
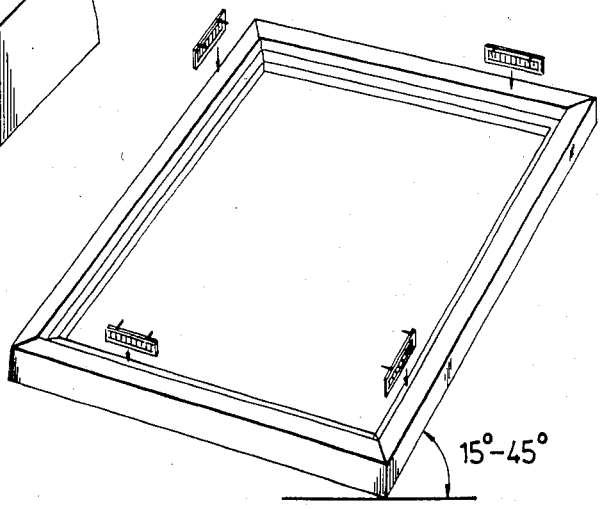
FIG. 3 illustrates the mounting of elements in a frame bar which inclines 15°–45° and is intended to be used for a specially hung frame.

In FIG. 1, the supporting and bracing element 1 comprises two elongated parallel edge ribs 2,3. Said ribs 2,3 are connected to each other by a large number of transverse ribs 4 constituting a centrally located part 5. The thickness of the central part 5 of the transverse ribs 4 is less than the thickness of the edge ribs 2,3 in order to form a draining groove 6 for removing condensation or moisture. Each of the transverse ribs 4 forming the central part 5 is arched with its thickness tapering in a direction towards its central portion. A loop formation 8 is provided at the end 7 of the edge ribs 2,3, said formation 8 connecting the edge ribs 2,3 and extending perpendicular to said edge ribs 2,3. The loop formation 8 has an extension perpendicular to the upper side of the supporting and bracing element which is generally about the same as the thickness of the edge ribs 2,3. When mounting the element 1 between the edge portion 10 of a sealed glazing unit 9 and a surrounding frame bar 11 as shown in FIG. 2 the loop formation 8 is compressible to the same thickness as the edge ribs 2,3, which is made possible by the location of the loop formation 8 outside the short side 12 of the edge ribs 2,3. The loop formation 8 is fastened to the ends 7 of the edge ribs 2,3.

A grooving 13 is provided on the upper- and under side of the edge ribs 2,3. Said grooving 13 extends in a longitudinal direction and is intended to couple together or connect a lot of elements 1 placed on top of each other and at the same time to prevent a sliding movement laterally of the elements 1 in relation to each other. Two locking pins 14 are provided on one longitudinal side of the edge ribs 2,3 and extend from the edge ribs 2,3 in a direction opposite to the direction of the loop formation 8. The locking pins 14 are provided to fix the supporting and bracing element 1 after mounting of a glazing bar 15, as shown in FIG. 2. The supporting and bracing elements 1 are preferably manufactured of plastics material with different thicknesses of the edge ribs 2,3 for example 2, 3 and 5 mm. If the elements 1 one on the top of another the thickness is the actual distance which exists between the edge portion 10 of a sealed glazing unit 9 and a surrounding frame bar 11. In order to more easily distinguish elements 1 having different thicknesses from each other, a special colour can be used for each thickness.

We claim:

1. An element for supporting and bracing a plate-like unit in a frame, comprising:

first and second parallel edge ribs extending in a longitudinal direction, each of the edge ribs having a first longitudinally extending side for being mounted against a plate-like unit and a second longitudinally extending side opposite the first side for being mounted against a frame, the first and second sides of each edge rib being spaced apart by a rib thickness, the edge ribs being spaced apart from each other in a transverse direction generally perpendicular both to the longitudinal direction and the rib thickness;

a central part between the first and second edge ribs for connecting the edge ribs to each other; and a loop member extending generally in the transverse direction between the first and second edge ribs, the loop member being movable in the direction of rib thickness between a first position in which the loop member extends beyond one of the first and second sides of the first and second edge ribs and a second position in which the loop member is jammed between the plate-like unit and the frame for holding the element in position while the plate-like unit is mounted in the frame.

2. The element of claim 1 in which the central part has a thickness less than the rib thickness for forming a drainage groove.

3. The element of claim 1 in which the loop formation has a thickness which is about the same as the rib thickness.

4. The element of claim 1 in which each of the first and second sides of each of the first and second edge ribs has grooves extending in the longitudinal direction defined therein for fitting the element against an adjacent element like the first-mentioned element and for preventing the first-mentioned element and the adjacent element from sliding in the transverse direction relative to each other.

5. The element of claim 1 in which the central part comprises a plurality of transverse ribs extending in the transverse direction between the first and second edge ribs.

6. The element of claim 5 in which each of the transverse ribs has a central portion and has a thickness tapering toward the central portion.

7. The element of claim 1 in which each of the first and second edge ribs has an end side, the end sides together defining an end of the edge ribs, the loop formation being located generally beyond the end of the edge ribs, the loop formation being connected between the end side of the first rib and the end side of the second rib.

8. The element of claim 1 in which the loop formation extends beyond one of the first and second sides in the first position, one of the first and second edge ribs having a longitudinal side disposed away from the other of the edge ribs, the element further comprising a locking pin on the longitudinal side extending in a direction opposite the loop formation beyond the other one of the first and second sides for holding the element in position after the plate-like unit is mounted in the frame.

9. An element for supporting and bracing a glazing unit in a frame, comprising:

first and second parallel edge ribs extending in a longitudinal direction, each of the ribs having a first longitudinally extending side for being mounted against a glazing unit and a second longitudinally extending side opposite the first side for being mounted against a frame, the first and second sides of each edge rib being spaced apart by a rib thickness, the first and second edge ribs being spaced apart from each other in a transverse direction generally perpendicular both to the longitudinal direction and the rib thickness; each of the first and second edge ribs having a respective longitudinal side extending in the longitudinal direction and disposed away from the other rib, the longitudinal sides of the first and second ribs being spaced apart in the transverse direction by a width generally about the same as width of the glazing unit;

a central part between the first and second ribs for connecting the ribs to each other, the central part having a thickness less than the rib thickness; and a loop formation extending generally in the transverse direction between the first and second ribs, the loop formation being movable in the direction of rib thickness between a first position in which the loop formation extends beyond one of the first and second sides of the first and second edge ribs and a second position in which the loop formation is jammed between the glazing unit and the frame for holding the element in position while the glazing unit is mounted in the frame.

10. The element of claim 9 in which the loop formation has a thickness which is about the same as the rib thickness.

11. The element of claim 9 in which each of the first and second sides of each of the first and second edge ribs has grooves extending in the longitudinal direction defined therein for fitting the element against an adjacent element like the first-mentioned element and for preventing the first-mentioned element and the adjacent element from sliding in the transverse direction relative to each other.

12. The element of claim 9 in which the central part comprises a plurality of transverse ribs extending in the transverse direction between the first and second edge ribs.

13. The element of claim 12 in which each of the transverse ribs has a central portion and has a thickness tapering toward the central portion.

14. The element of claim 9 in which each of the first and second edge ribs has an end side, the end sides together defining an end of the edge ribs, the loop formation being located generally beyond the end of the edge ribs, the loop formation being connected between the end side of the first rib and the end side of the second rib.

15. The element of claim 9 in which the loop formation extends beyond one of the first and second sides in the first position, the element further comprising at least two locking pins on the respective longitudinal side of one of the first and second ribs, the locking pins extending in a direction opposite the loop formation beyond the other one of the first and second sides for holding the element in position after the glazing unit is mounted in the frame.

* * * * *